United States Patent [19]

Tingley

[11] Patent Number: 4,709,513

[45] Date of Patent: Dec. 1, 1987

[54] GLASS SCRATCH REMOVAL METHOD

[75] Inventor: Eddie S. Tingley, Bloomington, Minn.

[73] Assignee: Novus Inc., Minneapolis, Minn.

[21] Appl. No.: 891,293

[22] Filed: Jul. 31, 1986

Related U.S. Application Data

[62] Division of Ser. No. 700,636, Feb. 11, 1985.

[51] Int. Cl.[4] ..... B24B 1/00

[52] U.S. Cl. ..... 51/283 R; 51/170 T

[58] Field of Search ..... 51/283 R, 284 R, 267, 51/272, 170 T

[56] References Cited

U.S. PATENT DOCUMENTS

| | | | |
|---|---|---|---|
| 412,548 | 10/1889 | Shufelt | 51/267 |
| 1,147,064 | 7/1915 | Wolf | 51/170 T |
| 1,698,970 | 1/1929 | Shaff | 51/267 |
| 2,423,112 | 7/1947 | Pantazakos | 101/47 |
| 2,733,562 | 2/1956 | Drummond | 51/267 |
| 2,906,256 | 9/1959 | Glynn | 125/20 |
| 3,012,384 | 12/1961 | Brown et al. | 51/283 |
| 3,041,793 | 7/1962 | Shimizu | 51/267 |
| 3,176,441 | 4/1965 | Walters | 51/283 |
| 3,243,922 | 4/1966 | Highberg | 51/283 |
| 3,673,744 | 7/1972 | Oimoen | 51/177 |
| 3,928,947 | 12/1975 | Millett | 51/170 T |
| 3,935,678 | 2/1976 | Marton | 51/170 T |
| 3,964,212 | 6/1976 | Kärden | 51/170 PT |
| 4,073,094 | 2/1978 | Walz | 51/111 R |

FOREIGN PATENT DOCUMENTS 2413086 10/1974 Fed. Rep. of Germany ..... 51/424

*Primary Examiner*—Frederick R. Schmidt
*Assistant Examiner*—Robert A. Rose
*Attorney, Agent, or Firm*—Kinney & Lange

[57] ABSTRACT

A glass scratch removal apparatus includes a driven rotating tool that is supported on a skirt that can be sealed against a surface to be treated for scratch removal. The skirt is conical and has some flexibility to permit the edge of the skirt in contact with the surface to deform in shape to follow curves or irregularities (such as on a curved windshield of an automobile) and at the same time, the skirt is held in place through the use of a vacuum. The rotating tool is pressed against the surface to lap and polish the surface. The tool is manually actuable toward and away from the surface, and a slurry is fed into the skirt to provide either for "fining" which is an initial step of rough removal of material adjacent the scratch and/or "polishing" which blends in or feathers the surface adjacent the scratch and provides for an optically satisfactory surface. The amount of pressure on the tool can easily be controlled at the same time that the tool is being moved across the scratch, so that the tools can be lowered gradually against the surface to be worked on to avoid gouges or burnished spots or the like.

5 Claims, 5 Drawing Figures

GLASS SCRATCH REMOVAL METHOD

This is a division of application Ser. No. 700,636, filed Feb. 11, 1985.

BACKGROUND OF THE INVENTION

1. Field of the Invention

The present invention relates to an apparatus and a method of using the apparatus for removing scratches from smooth surfaces such as glass.

2. Description of the Prior Art

Grinding and polishing glass has been done utilizing rotary grinders. Removing scratches from the surfaces of glass, such as windshields without leaving detectable surface dpressions or irregularities in a cost effective process has not been accomplished.

U.S. Pat. No. 3,012,384 shows a device for removing surface imperfections from bent glass sheets. This involves the use of a hand-held rotating surfacing tool. A hard felt cylinder is used as the polishing tool, and held in a chuck while it is rotationally driven. However, the removal of a surface imperfection such as a scratch using this process requires a high degree of skill, and is a completely manual task.

While hand drill driven grinder discs also have been tried, they rotate slowly, which makes good scratch removal and polishing almost impossible. High rotational speeds help in making a satisfactory scratch removal.

U.S. Pat. No. 3,176,441 shows a device for surfacing glass and, in particular, polishing both surfaces of a glass sheet as the sheet moves between the two polishing devices.

A lapping machine is shown in U.S. Pat. No. 2,423,112, for lapping surfaces, and it shows an orbiting-type surfacing member that is independently rotatably mounted onto a type of a crank which in turn is power driven for rotation so that the actual polishing wheel orbits about the powered rotational axis.

Other types of glass grinders have been utilized with a flow of cutting fluid. U.S. Pat. No. 2,906,256 shows a cutting tool that has a vacuum created on the inside of the tool to draw liquid across the cutting edge.. The flow keeps the tool and workpiece cool.

U.S. Pat. No. 4,073,094 shows a glass cutter which is driven from a motor having a hollow shaft through which a lubricating fluid is supplied to the cutter. In other words, the lubricating fluid is supplied from the interior of the shaft to the inside portions of the cutter and then the fluid flows out of the cutter.

U.S. Pat. No. 3,243,922 also shows a grinder with a lubricating or cooling flow coming in through the center and out the edges of the grinding wheel.

Thus, the use of grinding wheels, including orbiting grinding wheels, has been advanced, and the flow of fluid from the center of the tool outwardly also has been shown. However, the present device includes structure which permits use of lapping and polishing tools for rapid, reliable and repeatable polishing for removing scratches from surfaces, such as the surface of a pane of glass, even when the pane is curved.

SUMMARY OF THE INVENTION

The present invention relates to a tool that can be used for removing localized scratches in smooth surfaces, including surfaces that are curved, such as windshields. The tool comprises a power driven, high speed rotating shaft which can drive a selected type of grinding or polishing disc, and which is housed inside of a flexible, generally conical skirt. A vacuum is supplied to the interior of the skirt to hold the skirt onto the surface under vacuum force, and at the same time, provide for a flow of a polishing compound slurry across the polishing surface of the member.

In the form shown, the vacuum that holds the flexible skirt in place also causes the flow of the polishing compound-cooling slurry through the interior of the skirt.

In a method of carrying out the process of removing a scratch, first a "fining" or lapping operation is done, which is somewhat more abrasive than the later polishing operations utilizes an orbiting disc, with a suitable slurry in which it operates. A polishing step is then performed to provide a fine polish finish and long radius smoothness that is desired.

The present invention involve two separate types of rotating tools, but essentially one form of tool holder that uses a different drive shaft for each operation mounted in substantially the same type of housing used for different rotating tools. If desired, quick change chucks can be used for interchanging the tools, but inasmuch as the exact coupling of the rotating device to the drive shaft is not critical to performance of the invention or the method, the parts shown herein are shown as two separate assemblies.

In the process of removing a scratch from the surface of a windshield or other hard surface, such as any type of glass or other type of polished surface, it has been found that it is desirable, and in most instances necessary, to have two separate operations for satisfactory, repeatable results.

The first process is called a "fining" operation and this, essentially, uses a self leveling lapping disc (made of metal) which works a lapping compound in a slurry against the surface and has the capability of removing very small particles of material such as glass in a relatively short time. A high rpm drive operates the fining or lapping tool in a slurry that is passed through a housing or shroud that properly orients the tool and its drive assembly relative to the surface that is being worked on.

The second process is a polishing operation and utilizes the same tool assembly driving a felt pad that is rotated in a polishing slurry for providing a very smooth, gently concave surface, in a final step of the scratch removal.

In both operations, the same support and drive motor is utilized, and the unit is held onto the surface through the use of vacuum from a source that also transfers the slurry used through the shroud or support. The unit is capable of being moved along the surface as it rotates without breaking the vacuum seal and the engagement of the rotating tools with the surface being worked on is controlled manually so that the tool can be gradually lowered down to the surface as the tool is moving laterally to insure a smooth transition from the unworked surface to the polished surface.

DETAILED DESCRIPTION OF THE PREFERRED EMBODIMENTS

Figure 1:
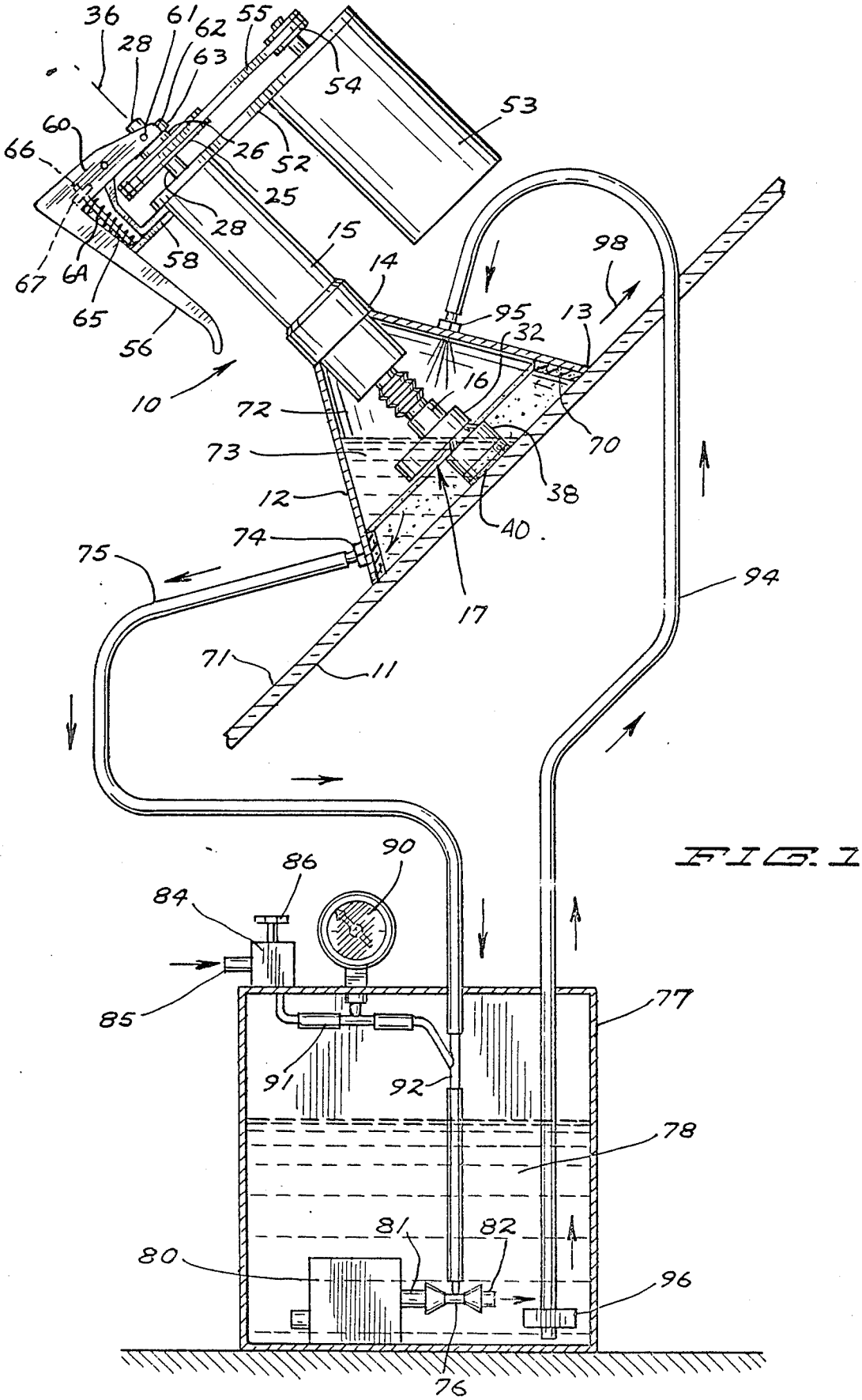
FIG. 1 is a sectional, part schematic view of an apparatus made according to the present invention shown in use in a fining operation in a first stage of polishing a scratch from an automobile windshield.

In FIG. 1, the tool arranged for the fining step is illustrated. The illustration is part schematic, and it is to be understood that the support housing and the tube supporting the drive shaft for the tool, as well as the drive motor arrangement, is the same for the tools used in both operations.

A scratch removal apparatus indicated generally at 10 is supported on the surface of a pane of glass 11 that has a scratch that is to be removed.

As shown, apparatus 10 includes a support housing or shroud 12 that is made of a semiflexible plastic, such as ABS plastic, and that is generally conically shaped. The housing has a lower edge indicated at 13 defining a line that is nominally a plane that lies along the planar surface of the glass pane 11 to be repaired. The cone-shape may deform so the line on edge 13 will define shapes other than circular so the line of edge 13 Will seal on a curved surface.

Figure 3:
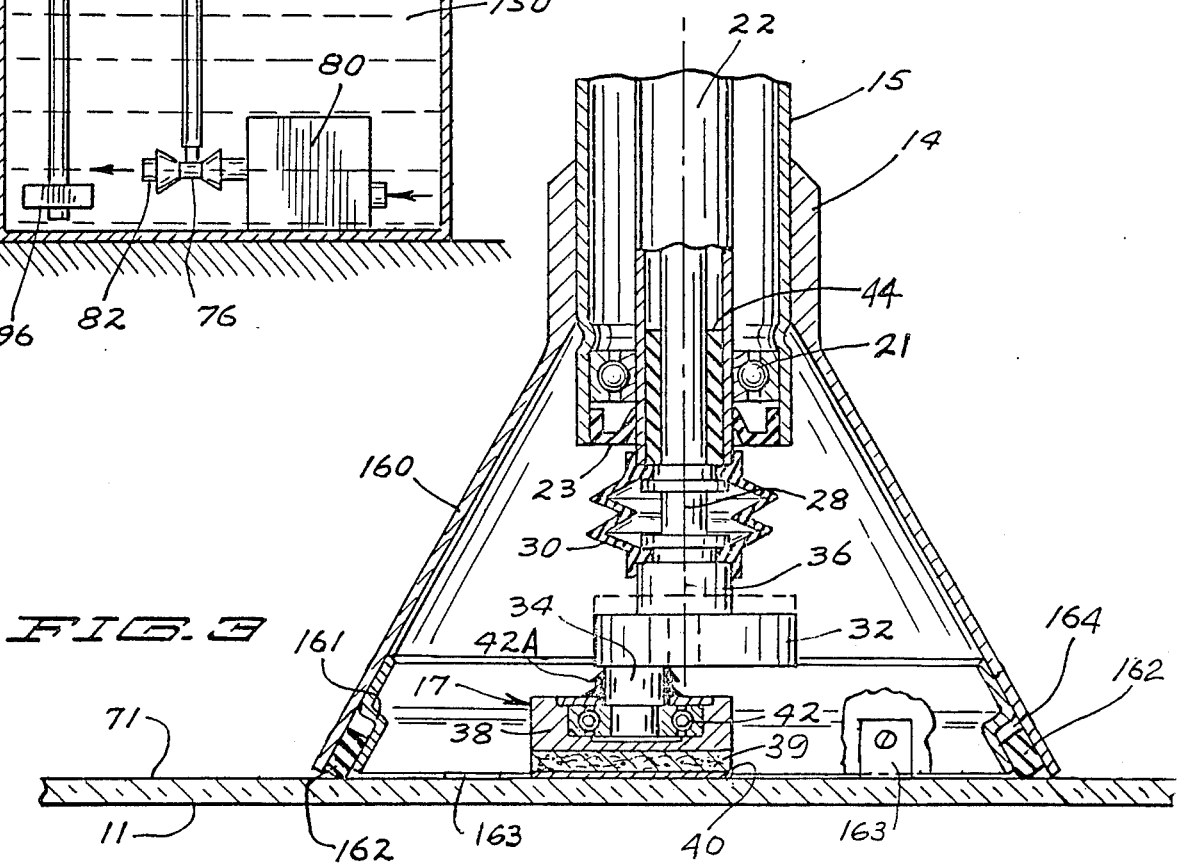
FIG. 3 is an enlarged sectional view of a grinding tool showing an orbital tool and a modified seal in greater detail.

The upper end or first end of the generally conical housing or shroud 12 is connected to a suitable collar 14 that in turn is fixed to a housing tube 15 at a desired level. The housing tube 15 supports a drive shaft for driving a hub 16 for an orbiting type lapping tool 17. The lapping tool is shown in greater detail in FIG. 3. As can be seen in FIG. 3, the outer housing tube 15 has a bearing 21 at the lower end thereof that rotatably mounts a tubular sleeve 22 which is drivably coupled to a pulley 25 at the upper end 22A thereof (FIG. 1), and as will be shown in connection with FIG. 4, the pulley 25 rotationally drives sleeve 22 through a suitable connector such as a spline or pin. An axially movable spider or hub 26 is driven by the pulley 25, as will be explained. The hub 26 is movable along the vertical or central axis and drives a central drive shaft 28, extending out the bottom of the sleeve 22. The drive shaft 28 may be slid axially on the inside of sleeve 22 with spider 26 but rotates at the same speed as the sleeve.

A suitable bellows seal 30 can be provided between the rotating sleeve 22 and shaft 28 and the hub 16. The hub 16 is drivably coupled to the shaft 28 in a suitable manner. The hub 16 has a disc 32 drivably mounted thereon to form part of the fining tool 17. As shown in FIG. 3, a stub shaft 34 extends perpendicular to the disc and is offset from the axis 36 of the sleeve 22 and shaft 28, and is used for rotatably mounting a pad support 38, that has a fining or lapping pad 40 of zinc or the like held on a compressible foam layer 39 which is fixed to the undersurface of pad support 38. The pad support 38 includes a bearing 42 that rotatably mounts the pad support 38 onto the shaft 34. In addition, a sealing boot 42A is provided to shield the bearing 42 from the slurry. The bearing 42 is made to provide some tilting of the pad for self-leveling.

Figures 4, 5:
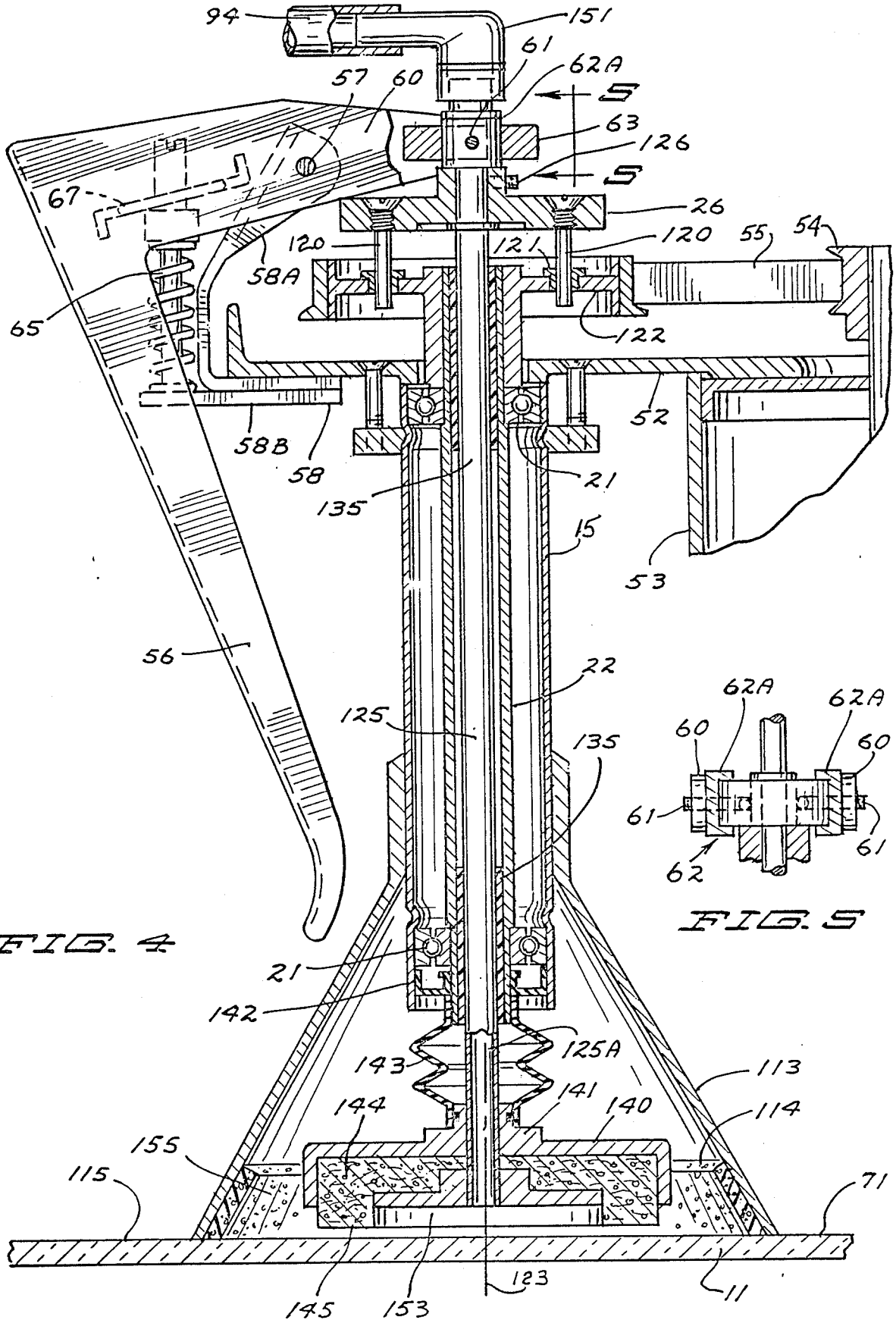
FIG. 4 is a vertical sectional view of the apparatus shown in FIG. 2.
FIG. 5 is a side view of the handle coupling bearing used with the mechanism of FIG. 4.

The sleeve 22 and the shaft 28 rotate together, and are drivably coupled as will be shown in FIG. 4, but the shaft 28 can slide axially, along the axis 36, relative to the sleeve 22. Suitable bushings one of which is shown at 44 in FIG. 3 are provided at spaced locations between the interior wall of sleeve 22 and the shaft 28 to permit this axial sliding movement.

Tubular housing 15 has an additional bearing 21 at the upper end to support the sleeve 22. The central axis of housing 15 is supported on the central axis of shroud or housing 12.

A motor support plate 52 is mounted to the upper end of the housing 15, and a motor (110 volt) indicated at 53 is mounted to the support plate spaced laterally of the tube 15. A pulley 54 is coupled to the output shaft of the motor 53, and a belt 55 drives the pulley 25.

The movement of the central shaft 28 along axis 36 is controlled by a manual handle or lever 56, that is supported on a pivot pin 57 relative to a bracket 58, attached to the plate 52. The handle 56 has an actuator arm section 60 that is connected with pivot pins 61 to a bearing carrier 62. The carrier 62 comprises two bearing holder clips (FIG. 5) which hold the outer race of a bearing 63 therein. The bearing 63 is a standard bearing which has an inner race supporting the interior shaft 28. The bearing 63 is prevented from axial movement with a suitable snap ring at the top and the hub or spider 26 so that when the handle 56 is pivoted, the actuator arm section 60 will cause the interior shaft (28 in FIG. 1) to be moved axially under control of the handle.

The handle 56 is urged in a direction about the pivot pin 57 so as to cause the arm section 60 to move toward the tube 15, that is, to urge the shaft and tool downwardly, through the use of a compression spring assembly 65. The spring assembly 65 includes a spring 64 that abuts against one portion of the bracket 58, and is guided with an adjustment rod 66 that extends through a suitable reaction bracket shown in dotted lines at 67 in FIG. 1. The bracket reacts force from the spring 64 to tend to pivot the lever arm 60 downwardly about the pivot pin 57. Thus, spring 64 will provide a spring load against the fining tool of FIG. 1 to urge it against the surface of the glass or pane 11 that is being worked on. The tool is urged toward the plane 13 defined by the lower edge of the shroud or housing 12.

In order to carry out the fining operation, it is desirable to have a slurry including abrasive or rubbing compound particles in the slurry in which the tool can work. In order to accomplish this, a seal member indicated at 70 is provided just inside the skirt or shroud 12 adjacent the plane 13, and extending slightly beyond the edge 13 in direction opposite from the upper end 14. The sleeve 14 is tightly fitted onto the housing 15, so that it will support the housing as previously stated, and the seal 70 then seals against the surface indicated at 71 that is being worked on, when there is a force holding the seal against the surface.

The housing or shroud 12 is held on the surface 71 under a vacuum on the interior thereof, above the level of the slurry on the interior of the shroud. The slurry is indicated generally at 73. The pane 11 being worked on is an inclined windshield of an automobile, so that the level of the slurry is tilted relative to the axis 36 of the drive shaft and shroud.

As shown, a fitting 74 is provided adjacent the lower end of the shroud or skirt 12, and is selected to be on a side thereof which would normally be on the low side of the skirt or shroud when the tool is in use. This fitting 74 is connected so that it has an interior passageway open to the interior of the shroud. A tube 75 is coupled to the fitting 74 , and in the form shown, the tube 75 is connected to the low pressure section of a venturi assembly 76 that is located inside a suitable container 77, well below the level of the slurry supply liquid indicated at 78 in the container. The venturi 76 is known and provides a low pressure section in the center between converging and diverging portions, and a low power consumption pump indicated at 80 is provided inside the container 77 to pump liquid comprising the slurry 78 out through a pump outlet tube 82, through the venturi 76, and then the liquid is discharged through a nozzle forming part of outlet tube 82 back into the container 77 below the level of the slurry liquid 78.

The vacuum created at the venturi 76 will act through tube 75 and chamber 72 to create a vacuum in a tube 94 to draw the slurry up into chamber 72. A quantity of slurry will accumulate in the chamber 72, depending on the lift, and the sizes of the inlet and outlet tubes. The slurry 73 in the chamber formed by the shroud will be drawn through the tube 75 into the venturi 76 and then discharged (along with the pump discharge) back out into the container 77. The amount of vacuum being drawn can be regulated by adjusting a vacuum regulator valve 84 that has an air inlet pipe 85, and a control handle 86. Controlling the vacuum level adjusts the rate of flow of the slurry. The level of the vacuum also adjusts the force holding the skirt onto the glass surface.

A vacuum gauge 90 can be coupled into a fitting in a conduit 91 that leads from the valve 84 to a Y connector 92 connecting two portions of the tube 75. By opening and closing the valve member 84, the amount of air being bled in through inlet 85 can be regulated and this will control the level of vacuum that is created with the venturi 76.

Because the seal 70 seals the interior chamber indicated at 72 inside the shroud 12, the vacuum is created in the shroud as the slurry 73 is pulled through the fitting 74 and tube 75. This partial vacuum is used for maintaining a supply of the slurry in the interior of the shroud 12 to keep the tool 17 working the slurry for abrading and also for cooling the windshield and tool.

The tube 94 is connected through a fitting 95 to a side of the shroud 12 opposite from the fitting 74 in an area which is not covered with the slurry 73. The free end of the suction tube 94 extends into the container 77, and has a weight 96 on the bottom end thereof to maintain it near the bottom of the container.

It should be noted that the outlet tube 82 from the pump 80 expels liquid under pressure, and this tends to agitate the slurry and maintain the solids in the slurry forming the polishing compound in suspension in the slurry. Thus, the pump serves not only as a low power consumption source of vacuum for moving the slurry through the interior chamber 72 of the shroud, but also for agitating the slurry in the container 77.

The partial vacuum inside the chamber 72 also tends to hold the shroud 12 and the housing 15, motor 53, and other accessories, against the surface 11. The amount of force or pressure holding the shroud in place is counteracted by the spring force from the spring 65 tending to push the shroud up as the tool pushes against the surface 71. The support forces for the tool are thus localized to the area under the shroud and are not reacted back to the frame that holds the windshield or glass pane.

The entire tool can be moved as indicated by the arrow 98, along the surface, at the same time that the orbiting fining tool 17 is working against the surface, utilizing the slurry to lap away a very fine layer of the glass or other material.

The manual lever 56 permits lifting the fining tool away from the surface, generally as shown by the dotted lines in FIG. 3, and at the same time, provide agitation.

A problem which is faced with portable electrically powered tools, such as the apparatus disclosed, is that they will be used where an extension cord is necessary, as for example, repairing the scratch on a windshield of an automobile, and the use of a small pump such as pump 80, which also acts as a vacuum pump insures that there will be adequate power, approximately 12 amps, for running the drive motor 52 for the lapping or polishing tool.

Powering a separate vacuum pump source and a separate pump for the slurry, as well as powering the main motor pump with only one extension cord and from one 15 amp circuit is a problem, so the two functions of vacuum and slurry supply pump combined into one provide a benefit from a powering standpoint. The agitation achieved by pumping the material through the venturi back into the tank through the outlet 82 insures that the polishing particles are distributed in a liquid carrier.

The surface of a glass pane 11 may have a localized scratch that may be as much as 0.001 inch deep, and about a two inch wide band along the scratch is lapped or "fined" and then later polished. Optically correct feathering of the surface from the scratch is important, and, of course, doing it economically is also important.

As the tool 17 is lowered into contact with surface 71 and also as it is removed from contact with the surface by operating handle 56, the shroud 12 and tool will be slid laterally along the surface. The tool will not be started while it is in contact with the surface. This is important in the initial startup so there isn't any burnished spot or circular ground spot that would be left as could happen if the tool is left stationary when the motor 53 is started. The work does have to be visually inspected, so the tool can be lifted and the shroud moved to expose the scratch area without breaking the vacuum seal at the edge of the shroud which contacts and seals on the surface of pane 11.

The motor 53 is a very high speed motor and the tool may be rotating in the range of 6000 to 7000 rpm.

In the first stage of operation, the lapping or "fining" tool is operated to lap a band with feathered edges along the sides of the scratch down to almost the level of the bottom of the scratch.

Figure 2:
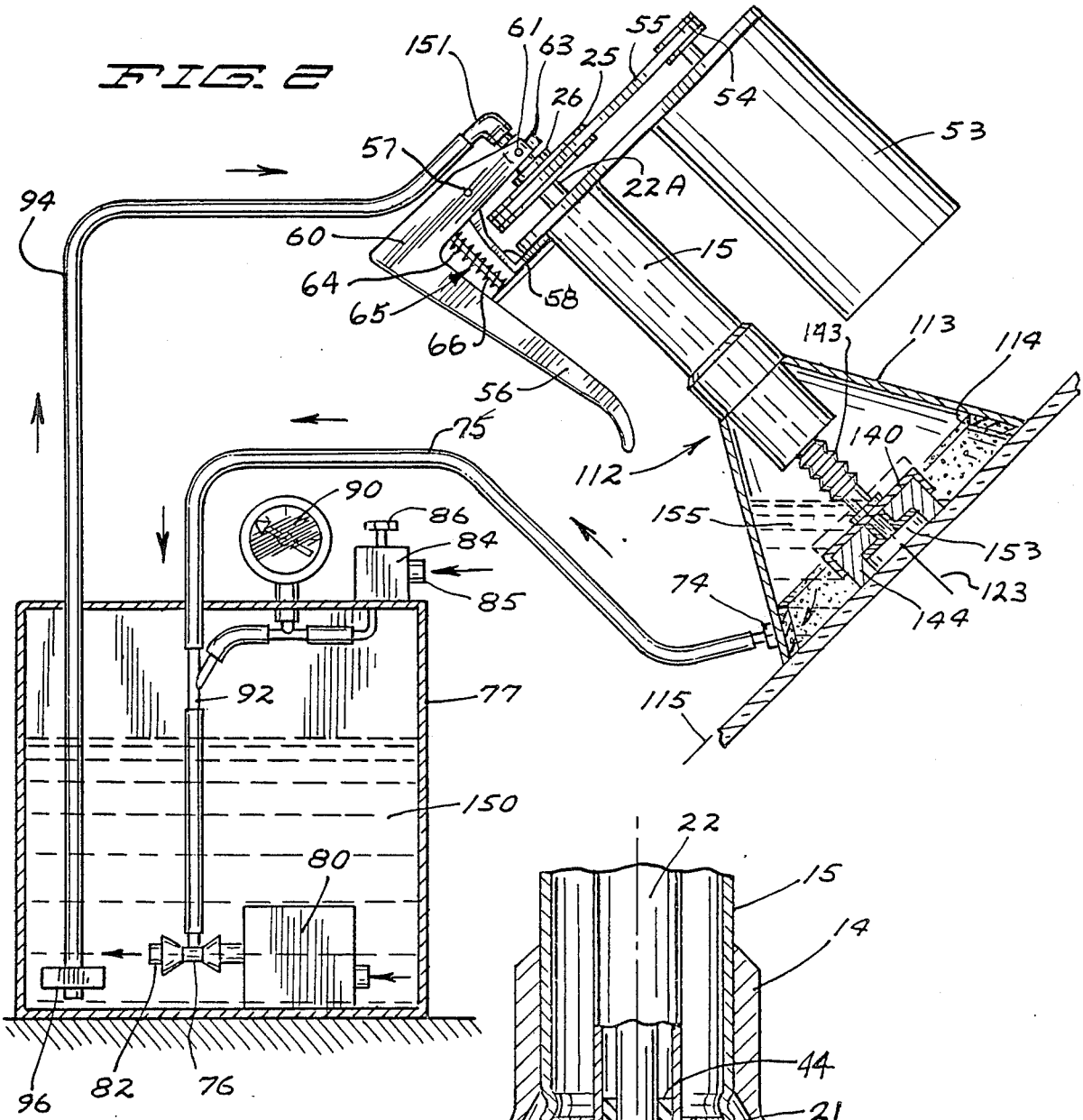
FIG. 2 is a sectional, part-schematic view of the apparatus of the present invention shown in a configuration for the polishing operation for finishing a scratch removal process.

In FIG. 2, and also in FIG. 4, the apparatus for the polishing operation subsequent to the lapping or fining operation is illustrated.

In this form, different numbers will be used for the center drive shaft, but the drive motor 53, and the supports and the like, are all shown with the same numbers. However, there is a different connection of tubes for feeding in the slurry that is used for the polishing operation. The container 77 for the slurry is the same, as well as the adjustment valve for regulating the vacuum.

In this form of the invention, the polishing tool shown at 112 has the outer tube 15 mounted onto a skirt or shroud 113, which has a seal 114 around the perimeter thereof, and the lower edge of which defines a plane 115. The motor 53 in this form of the invention drives the pulley 54 and belt 55, to drive the main drive pulley 25 which is drivably mounted on the upper tube section 22A and thus drives the tube 22, as shown in more detail in FIG. 4.

As shown in detail in FIG. 4, the drive spider 26 has drive pins 120 fixed thereto which slide in suitable bushings 121 in a web 122 forming part of the pulley 25. This permits the drive spider 26 and the pins 120 to slide axially along the axis shown at 123 for the interior drive tube shown at 125 which forms a drive shaft for the polishing tool (and corresponds to shaft 28) as will be explained. The drive spider 26 is pinned with a suitable pin 126 to the tubular shaft 125 so that there is a drivable connection. A similar pin can be used for driving the shaft 28 for the fining tool.

The arm section 60 of handle 56, as shown in FIG. 4, is connected through the bearing carrier 62 to the bearing 63 which permits rotation of the shaft 25 relative to the outer race and the carrier 62 so the axial movement of the tubular shaft 125 can be controlled.

As shown, the handle 56 is mounted onto the support 58, which has the upright extending arm 58A for the mounting of pin 57, and also shown in greater detail is the spring assembly, held on a lower portion 58B of the bracket 58.

Further, the motor support member 52, as shown in FIG. 2, has an upstanding rim for reinforcement, so it can support the motor 53 adequately.

The interior tubular shaft 125 is suitably mounted in low friction bearings 135 in the outer tube 22, as previously explained, and the upper bearing 21 inside the tube 15 is also shown in FIG. 4. The shaft 28 used with the fining tool is mounted in the same manner as tubular shaft 125.

The bushings 135 can be low friction material such as Teflon, and while they do not support the tubular shaft 125 for rotation, they permit linear sliding movement along the axis 123.

In this form of the invention, the tubular shaft 125 extends down and supports a polishing tool 140. The polishing tool 140 has a hub 141, and as shown, the tube 22 has a seal 142 at its lower end to seal off against liquid flow toward the bearings. A suitable boot 143 is provided over the lower end of the rotating tube 22 and down to the hub 141. The polishing tool 140 as shown comprises a cup that is drivably mounted onto the tubular shaft 125, and supports a felt pad 144 on its interior surface. The felt pad as shown in FIG. 4 is raised from the surface 71 of the pane 11 that is being finished, and the underside plane 145 of the felt pad 144 is the surface that will engage the surface 71 when the handle 56 is released so that the spring 65 can move the handle to lower the shaft 125.

In this form of the invention, the seal 114 on shroud 113 rides along the pane 11, against the surface 71, and forms a fluid seal as before. A discharge fitting 74, as in the first form of the invention is provided in the skirt or shroud 113, and this connects to tube 75, and through a venturi 76 on the interior of a tank 77 (see FIG. 2). The pump 80 is operable to create a vacuum on the interior of the shroud 113. The slurry, however, indicated at 150 would be for polishing, and would be of a different consistency having different polishing particles than the fining slurry.

The slurry intake tube 94 for the polishing tool is connected through a rotating fitting 151 coupled to the upper end of the tubular shaft 125, and the liquid that is sucked in through the suction tube 94 passes through the interior passageway shown at 125A in FIG. 4 into the interior chamber 153 of the felt pad, and then out into a reservoir portion 155 formed on the interior of the shroud which holds the polishing slurry.

Fitting 151 can be any type of suitable swivel having bearings that are capable of taking the rotational speeds of the tubular shaft 125.

A modified seal and sliding support is shown in FIG. 3. The shroud 160 is cone shaped as before and a flange 161 is provided on the interior of the remote end of the shroud. Flange 161 forms a receptacle 164 which supports a foam seal 162 for engaging surface 71. The receptacle 164 has a height greater than the height of the seal, so the seal 162 will float or slide slightly in the receptacle. This insures sealing along contours of the glass surface as well as accommodating slight irrregularties. A plurality of glide clips or sliding feet 163 are fastened at spaced locations around the shroud to provide nonlapping support points or feet. The feet are preferably very high molecular weight nylon which is low friction to lower the forces needed for sliding the tool. Also, the material does not tend to lap in the presence of an abrasive slurry. The support clips are replaceable if they wear.

The seal 162 has a shape to insure a seal is made against the surface being processed along an annular line defining the interior chamber.

The seal 162 will be compressed when the glides or feet rest on the surface, but not excessively compressed. The compression will be sufficient to maintain the vacuum seal necessary for providing the retaining force and the transfer of the slurry.

The slurry for the polishing operation feeds into the center of the polishing pad 140 and out past the outer edges as the pad rotates, to keep the glass cool and provide polishing compound for an adequate polishing job as the unit is slid back and forth across the path of the scratch in uniform strokes to provide a optically acceptable, well-feathered, depression that removes the scratch from the surface.

The shroud, again, is of great importance in that the flexibility of the skirt member, with its relatively large diameter, where it contacts the surface and permits the seal along a curved surface by bulging or deforming in desired locations.

By controlling the pressure of the fining and polishing pads both, as the tools are moved across the surface, tapering is easily achieved.

Even though the shroud is capable of conforming along its lower edges to curves and the like, it has rigidity, so that the axis of the cone, which is also the axis of rotation of the tool drive shaft, remains substantially normal to the center of the shroud. The tool axis does not tend to tilt, which would cause an edge of the polishing tool to be overloaded. The seal on the shroud must be flexible enough to accommodate the curve of the windshield without losing the vacuum in the shroud. The forces on the tools substract from the vacuum forces and can be controlled. The fining tool is loaded with about 10 pounds force and the polishing tool has about 40 pounds force on it.

The handle 56 is used to lift the polishing pad and lower it gradually as the shroud is moved laterally to taper the edges of the polished region. The switch for the motor is placed adjacent the handle 56 so it can be operated easily.

Although the present invention bas been described with reference to preferred embodiments, workers skilled in the art will recognize that changes may be made in form and detail without departing from the spirit and scope of the invention.

What is claimed is:

1. A method for removing scratches from a smooth surface of a hard, substantially nonporous material while such material is in place for use comprising the steps of:

mounting a rotating tool on a manually movable support about an axis which is generally normal to the surface and supporting said tool and support on said surface;

providing a resilient force relative to the support urging said tool toward said surface with the support engaging the surface and manually controlling the position of the tool relative to the support to permit selectively moving the tool away from said surface and to permit controlling the force of the tool against the surface up to a preselected maximum;

rotating said tool; and moving the support along the surface and over the region where the scratch is to be removed and manually holding the tool spaced from said surface until the support is moving along said surface and gradually lowering said tool into engagement with said surface while the support is being moved across said surface.

2. The method as specified in claim 1 including the steps of:

providing said support as an enclosed generally conical chamber with the wide end of the cone defining an edge capable of sliding movement along said surface;

sealing the edge against the surface; and providing a slurry of material for polishing in said conical chamber as said support is engaged against the surface prior to the moving step and at the same time the tool is engaging the surface.

3. The method of claim 2 including the steps of:

providing a first tool for abrading away portions of said surface adjacent such scratch during each of the previously recited steps; and subsequently providing a second tool for fine polishing separately using each of the previously recited steps subsequent to the removal of material by said first tool.

4. The method of claim 1 and including the step of manually reducing the pressure of the tool on the surface and lifting the tool from the surface as the support is moved along the surface.

5. A method for removing scratches from a smooth surface of a hard, substantially nonporous material comprising the steps of:

mounting a rotating tool on a manually movable support about a axis which is generally normal to the surface and supporting said tool on the support relative said surface with the axis of rotation of the tool generally normal to the surface;

providing a force urging said tool toward said surface relative to the support and manually controlling the movement of the tool toward the surface in opposition to said force to permit manually and selectively moving the tool away from said surface;

rotating said tool on said support while the tool moves with said support while abrading the surface adjacent a scratch to be removed; and moving the support along the surface and over the region where the scratch is to be removed and holding the tool spaced from said surface until the support is moving along said surface, and gradually lowering said tool into engagement with said surface while the support is being moved across said surface to provide a feathering action as the tool engages the surface.

* * * * *